US006520078B1

(12) United States Patent
Motoe

(10) Patent No.: US 6,520,078 B1
(45) Date of Patent: Feb. 18, 2003

(54) STENCIL PRINTING MACHINE

(75) Inventor: Katsuro Motoe, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 13 days.

(21) Appl. No.: 09/662,321

(22) Filed: Sep. 14, 2000

(30) Foreign Application Priority Data

Sep. 22, 1999 (JP) ..... 11-268857

(51) Int. Cl.[7] ..... B41F 15/10
(52) U.S. Cl. ..... 101/116; 101/118
(58) Field of Search ..... 101/115, 116, 101/117, 118, 119, 121, 122, 123, 124

(56) References Cited

U.S. PATENT DOCUMENTS 5,048,416 A 9/1991 Iijima
5,375,516 A * 12/1994 Hasegawa ..... 101/115
6,334,387 B1 * 1/2002 Motoe ..... 101/116

FOREIGN PATENT DOCUMENTS

EP 0 583 076 2/1994

OTHER PUBLICATIONS

Patent Abstracts of Japan, vol. 1995, No. 05, Jun. 30, 1995 & JP07 040643 A (Tohoku Ricoh Co., Ltd.), Feb. 10, 1995.

* cited by examiner

*Primary Examiner*—Andrew H. Hirshfeld
*Assistant Examiner*—Kevin D. Williams
(74) *Attorney, Agent, or Firm*—Kanesaka & Takeuchi

(57) ABSTRACT

A stencil printing machine including a plurality of printing drums which are arranged to be spaced apart from each other such that respective axis lines thereof are respectively made horizontal and respective peripheral walls of which are wound with perforated stencil sheet, a stencil making unit for perforating the stencil sheet and a moving mechanism for supporting the stencil making unit to be movable relative to the respective printing drums.

5 Claims, 4 Drawing Sheets

STENCIL PRINTING MACHINE

BACKGROUND OF THE INVENTION

1. Field of the Invention

The present invention relates to a stencil printing machine perforating stencil sheet mounted to a printing drum and capable of carrying out printing operation by using thereof, particularly to a stencil printing machine supplying perforated stencil sheet to a plurality of printing drums.

2. Description of the Related Art

FIG. 4 is a side view showing a conventional stencil printing machine. Stencil sheet S to be perforated is wound in a roll-like shape and is rotatably supported. The stencil sheet S reeled out from the stencil sheet S in the roll-like shape is constituted by a shape of a continuous strip. The reeled-out stencil sheet S is pinched between a thermal head 50 and a platen roller 51.

The stencil sheet S is heated and perforated by the thermal head 50 (stencil making operation). In carrying out the heating and stencil making operation, the stencil sheet S is transferred by rotation of the platen roller 51 while being brought into contact with the thermal head 50. Thereafter, the stencil sheet S is contained in a storage box 52 until finishing the heating and stencil making operation of one block by the thermal head 50. The stencil sheet S is contained in the storage boxes 52 by feeding the stencil sheet only by the platen roller 51 while upper and lower load rollers 53 and 54 disposed above the storage box 52 are stationary and pinching the stencil sheet S. Further, a common transfer path 55 is arranged at the front side of the storage box 52. The common transfer path 55 is provided with cutter means 56 for cutting one block of the perforated stencil sheet S.

After finishing the heating and stencil making operation, the thermal head 50 is moved in an upper direction to thereby release the stencil sheet S from being pinched by the thermal head 50 along with the platen roller 51. The stencil sheet S finished with the heating and stencil making operation is In the meantime, according to the stencil printing machine shown by FIG. 4, the perforated stencil sheet S is transferred to two of the printing drums 57. Therefore, the stencil printing machine is provided with respective transfer paths 58 for feeding the stencil sheet S from the common transfer path 55 to the respective printing drums 57 and a switch mechanism 60 for selectively switching the paths to communicate the paths from the common transfer paths 55 to either of the transfer paths 58. Each of the transfer paths 58 guides the stencil sheet S between upper and lower guide plates 58*a* and 58*b* and transfers the stencil sheet S by a plurality of transfer roller pairs 59. The switch mechanism 60 is arranged between the common transfer path 55 and the respective transfer paths 58 and is provided with a shunt transfer path 62 movable by a solenoid 61. The shunt transfer path 62 moved by the solenoid 61 opens the path to communicate from the common transfer path 55 to one of the transfer paths 58 or opens the path to communicate from the common transfer path 55 to the other of the transfer paths 58.

The stencil sheet S transferred to one of the transfer paths 58 or the other of the transfer paths 58, is pinched by a clamp plate 63 disposed at the printing drum 57 at its front end, fixed to the printing drum 57, thereafter transferred by rotation of the printing drum 57 and is made to wrap on a peripheral face of the printing drum 57. Further, the stencil sheet S is cut into one block by the cutter means 56 during the transfer operation or in arrival at the printing drum 57.

Further, the stencil printing machine shown by FIG. 4 is adopted in a printing machine. A portion of a constitution of the printing machine is not illustrated. A portion of a peripheral wall 64 of the printing drum 57 is ink-permeable. There is provided ink supply means, not illustrated, for supplying ink to an inner face of the peripheral wall 64 at inside of the printing drum 57. There is provided pressing means, not illustrated, for pressing print sheet to the printing drum 57 below the printing drum 57. The printing machine rotates the printing drum 57, feeds print sheet between the printing drum 57 and the pressing means at predetermined timings and presses print sheet at image portions of the stencil sheet S mounted to the printing drum 57. Printing ink supplied from inside of the printing drum 57 passes through the peripheral wall 64 of the printing drum 57 and is transcribed from perforated portions of the stencil sheet S onto print sheet to thereby form picture.

However, according to the above-described conventional stencil printing machine, when the perforated stencil sheet S is transferred to the printing drum 57, there is needed the long transfer path 58 for transferring the perforated stencil sheet S to the printing drum 57 particularly remote from a position where the stencil printing machine per se is installed. Further, when the transfer path 58 is long, a large number of the transfer roller pairs 59 is needed. Further, there is needed the switch mechanism 60 for switching the paths from the common transfer path 55 to the respective transfer paths 58. As described above, there poses a problem that in the conventional stencil printing machine, a number of constituent parts for transferring the perforated stencil sheet S is large.

Further, when a large number of the transfer roller pairs 59 is used, there is a concern in which balance of pinch pressure at the respective transfer roller pairs 59 is delicately deteriorated and the stencil sheet S is transferred in an oblique direction. Thereby, there poses a problem that there causes mounting position failure in which a position of mounting the stencil sheet S to the printing drum 57 is not disposed at a predetermined position or wrinkle is caused in the stencil sheet S mounted to the printing drum 57.

Further, by prolonging the transfer path 58, there poses a problem that the stencil sheet S is clogged between the upper and the lower guide plates 58*a* and 58*b* or a front end of the stencil sheet is folded. The above-described problem is liable to occur particularly in the stencil sheet S used in the printing machine since the stencil sheet S comprises a sheet produced by pasting a heat-sensitive film together with a porous supporter such as Japanese paper and accordingly, the stencil sheet S is easy to fold.

Hence, in order to resolve the above-described problems, it is an object of the present invention to provide a stencil printing machine capable of feeding stencil sheet to a plurality of printing drums without causing mounting failure or transfer failure.

SUMMARY OF THE INVENTION

According to a first aspect of the present invention, there is provided a stencil printing machine comprising a plurality of printing drums arranged to be spaced apart from each other at intervals and wound with perforated stencil sheet at respective peripheral walls thereof, a stencil making unit for perforating the stencil sheet, and a moving mechanism for supporting the stencil making unit to be movable relative to the respective printing drums.

According to a second aspect of the present invention, there is provided the stencil printing machine according to the first aspect wherein the moving mechanism comprises a guide portion for supporting the stencil making unit movably relative to the respective printing drums, a drive portion for moving the stencil making unit via the guide portion, and position detecting means for detecting that the stencil making unit is disposed at a desired position.

According to a third aspect of the present invention, there is provided a stencil printing machine comprising a plurality of printing drums arranged horizontally to be contiguous to each other at intervals such that respective axis lines thereof are made parallel to each other and respective peripheral walls being wound with perforated stencil sheets, a stencil making unit for perforating and delivering the stencil sheets to be wound around the printing drums, a guide portion provided along a moving path including a plurality of mounting positions at which the stencil making unit respectively supplies the stencil sheets to the respective printing drums and supporting the stencil making unit to be capable of moving along the moving path, a drive portion provided at the stencil making unit for moving the stencil making unit along the guide portion, and position detecting means arranged along the moving path of the stencil making unit and having a number larger than a number of the printing drums provided along the moving path such that the stencil making unit can be detected to be disposed at the mounting positions and disposed at a middle position between contiguous two of the mounting positions.

DETAILED DESCRIPTION OF THE PREFERRED EMBODIMENTS

A specific explanation will be given for embodiments of the present invention in reference to the drawings as follows.

Figure 1:
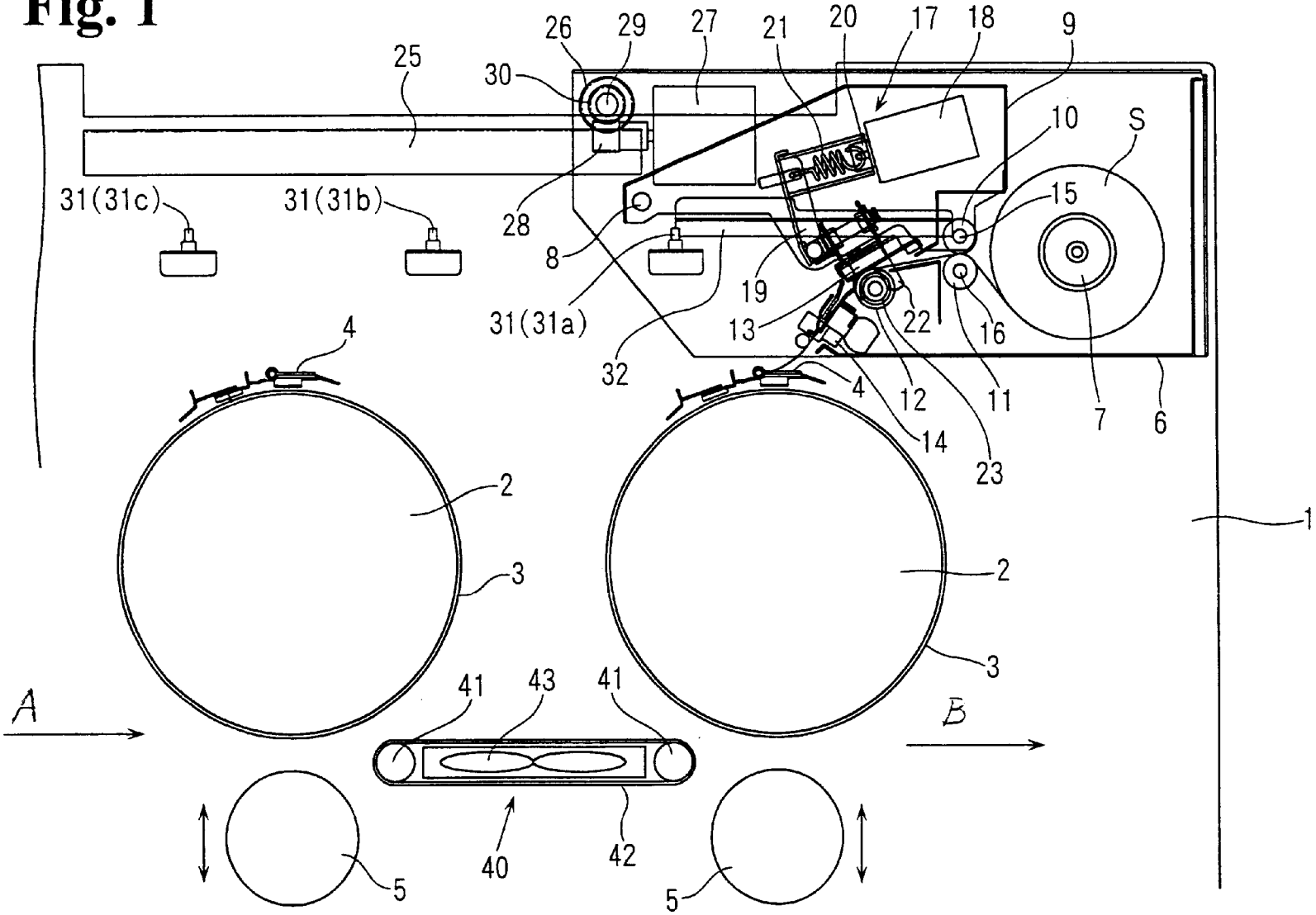
FIG. 1 is a side view showing an example of a stencil printing machine according to the present invention.
Figure 2:
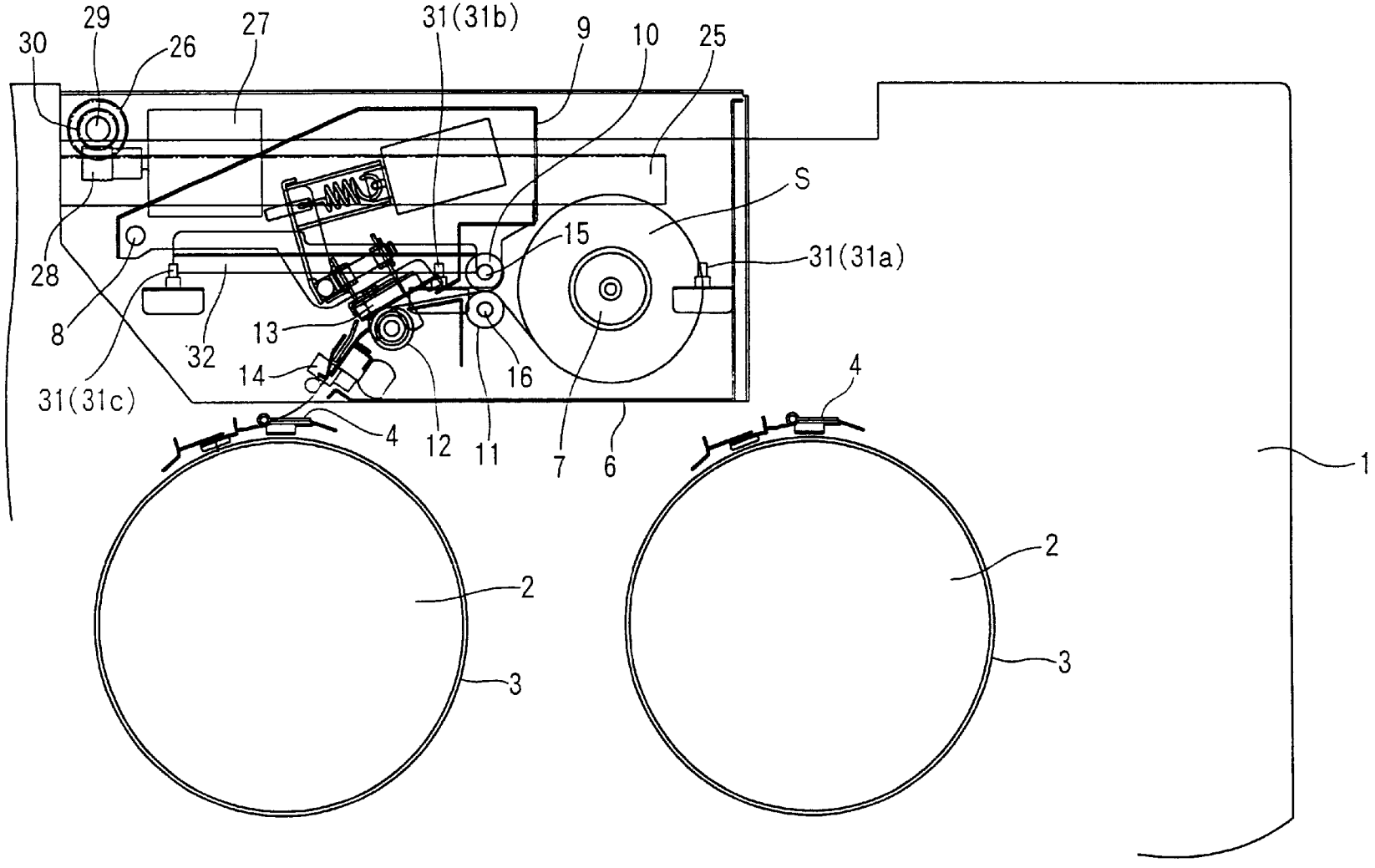
FIG. 2 is a side view showing operation of the stencil printing machine.
Figure 3:
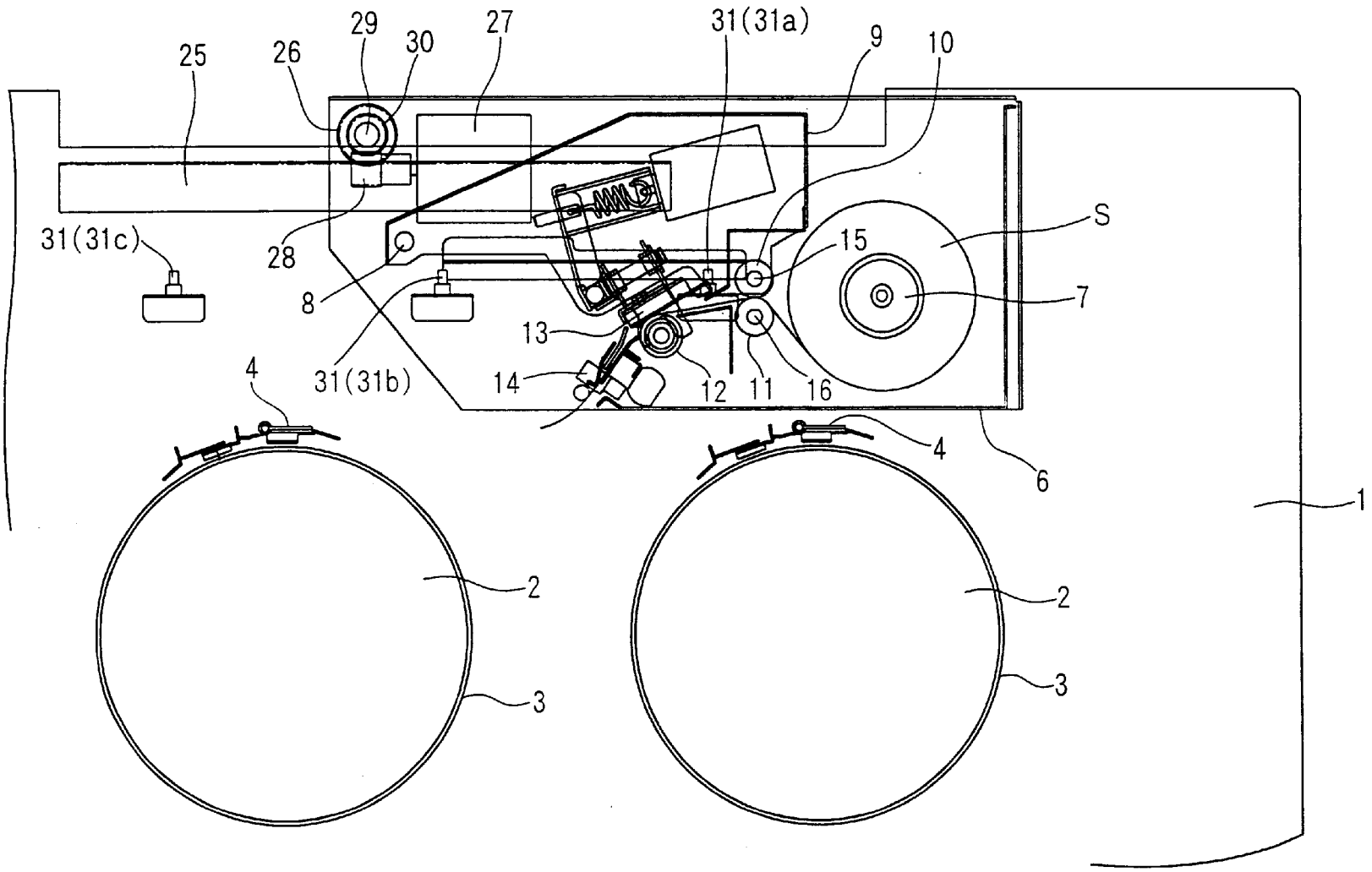
FIG. 3 is a side view showing the operation of the stencil printing machine.
Figure 4:
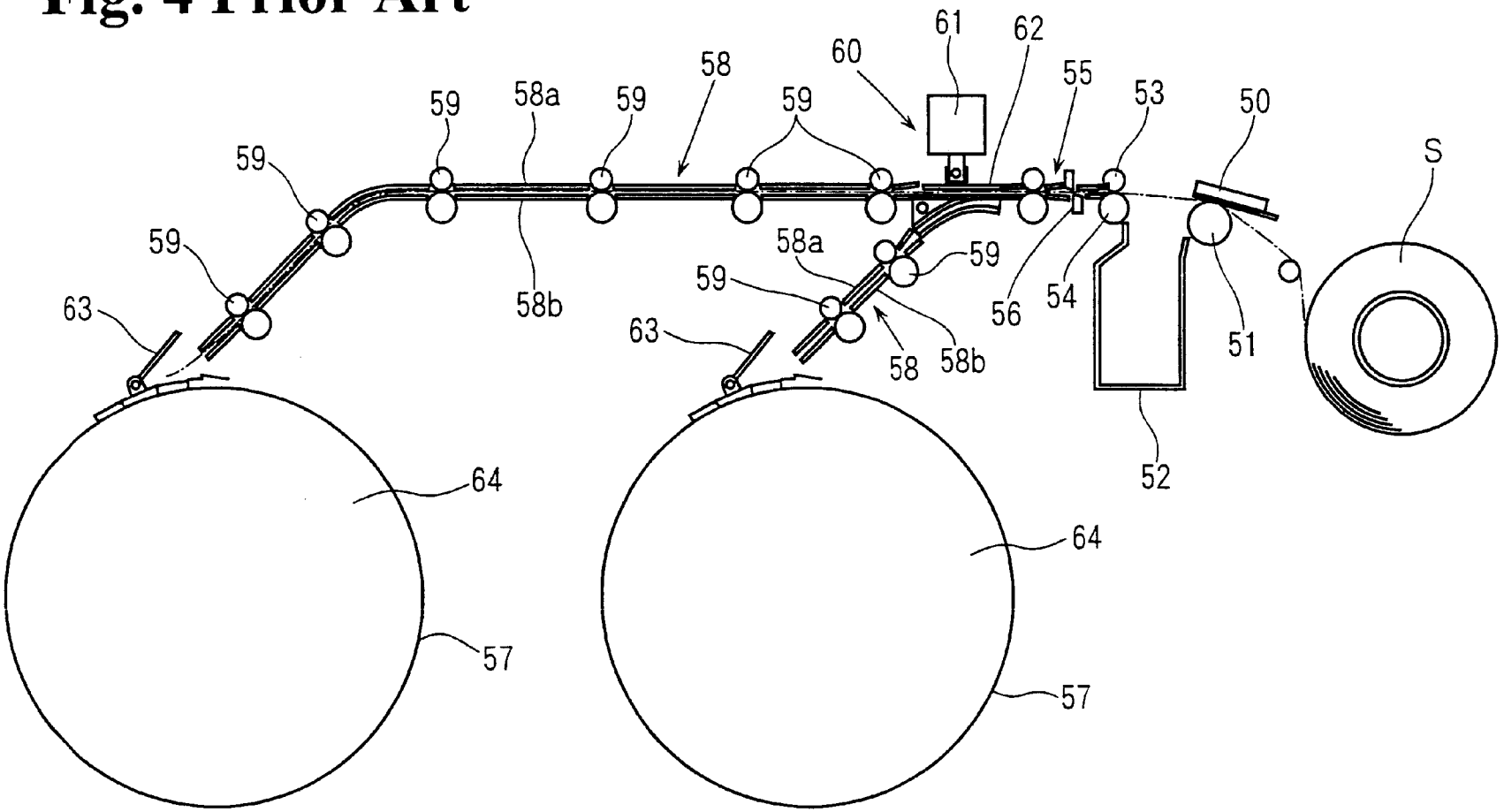
Fig. 4 Prior Art
FIG. 4 is a side view showing a conventional stencil printing machine.

FIG. 1 is a side view showing an example of a stencil printing machine according to the present invention and FIG. 2 and FIG. 3 are side views showing an operation of the stencil printing machine.

The stencil printing machine according to the example is provided with a perforating function for heat-sensitively perforating a stencil sheet by a thermal head and is adopted in a printing machine for carrying out perforation printing on a print sheet by using a perforated stencil sheet.

As shown by FIG. 1, there is provided printing drums 2 at inside of a machine body 1 of the printing machine. The printing drum 2 is provided with a peripheral wall 3 substantially in a cylindrical shape at least a portion of which is ink-permeable, a clamp plate 4 provided at an outer peripheral face of the peripheral wall 3 and ink supply means, not illustrated, provided on an inner side of the peripheral wall 3 for supplying ink to an inner peripheral face of the peripheral wall 3. The clamp plate 4 is fixing means for clamping a front end portion of a stencil sheet wound on the outer peripheral face of the peripheral wall 3. The printing drum 2 is driven to rotate on an axis line of its own. Further, there is provided pressing means 5 for pressing a print sheet to the printing drum 2 below the printing drum 2. As the pressing means 5, as shown by FIG. 1, there is provided a press roller which can be brought into contact with the printing drum 2 and can be separated therefrom. Other than these, although not illustrated, the pressing means 5 is provided with a press drum having a diameter same as that of the printing drum 2 and rotated in contact with the printing drum 2 in a state of being wound with the print sheet.

According to the printing machine, there is provided a plurality of the printing drums 2. According to the embodiment, there are provided two printing drums 2. The respective printing drums 2 are arranged such that respective axis lines of their own are in parallel with each other and horizontal. Further, there is provided transfer means 40 between the respective printing drums 2 for transferring the print sheet printed by one of the printing drums 2 to the other of the printing drums 2.

According to the transfer means 40, an endless belt 42 is made to span two rollers 41 arranged at vicinities of the respective printing drums 2. The belt 42 is circulated by driving the rollers 41. There are provided sucking mechanisms 43 of, for example, fans between the respective rollers 41 for sucking the print sheet to be transferred and pulling the print sheet to the belt 42.

In this way, the stencil printing machine having a plurality of the printing drums 2 enables multiple (multiple color) printing for printing on the print sheet at one of the printing drums 2 and printing on the print sheet successively at the other of the printing drum 2.

The stencil printing machine adopted to the above-described printing machine is arranged in a frame 6 supported in the machine body 1. The frame 6 is provided with a master holder 7 for rotatably holding a stencil sheet S wound in a roll-like shape. The stencil sheet S is a sheet produced by pasting together a heat-sensitive film and a porous supporter. Further, an upper side of the frame 6 can be opened from a closed state shown by FIG. 1 by a press plate frame 9 opened and closed via a support shaft 8.

Between the master holder 7 and the printing drum 2 on 15 the right side of FIG. 1, there are respectively provided a nip roller 10 and a tension roller 11, a platen roller 12 and a thermal head 13 and a cutter unit 14 in this order from the side of the master holder 7. The stencil sheet S is transferred via the rollers and the like and is heat-sensitively perforated by the thermal head 13.

As shown by FIG. 1, the nip roller 10 is rotatably supported via a shaft 15 supported by the side of the press plate frame 9. The press plate frame 9 is formed with a long hole (not illustrated) which is long in the vertical direction and the shaft 15 is supported via the long hole. Thereby, the nip roller 10 is movable in the up and down directions along the long hole and is brought into contact with the tension roller 11 by its own weight.

The tension roller 11 is supported rotatably via a shaft 16 supported by the side of the frame 6 below the nip roller 10. A peripheral face of the tension roller 11 is provided with a high friction material such as rubber or is surface-treated to produce a high friction state. Therefore, the stencil sheet S transferred in contact with the tension roller 11 is restrained from being slipped. Further, a torque limiter (not illustrated) is provided at the shaft 16 of the tension roller 11. Therefore, in transferring the stencil sheet S, the tension roller 11 is not rotated idly but constant torque is produced.

The stencil sheet S reeled out from the stencil sheet S in the roll-like shape, is transferred by being pinched between the nip roller 10 and the tension roller 11. The tension roller 11 prevents slippage of the transferred stencil sheet S by the above-described surface treatment. Further, since the torque limiter is provided at the shaft of the tension roller 11, the tension roller 11 is not rotated idly but constant torque is applied in transferring the stencil sheet S. Thereby, the stencil sheet S pinched by the tension roller 11 and the nip roller 10 is transferred between the platen roller 12 and the thermal head 13 in a state of being always applied with constant tension.

As shown by FIG. 1, the thermal head 13 is attached to the press plate frame 9. The thermal head 13 is formed substantially in a shape of a strip plate which is long in the depth direction of FIG. 1, installed orthogonally to a transfer direction of the transferred stencil sheet S and is brought into contact with an upper face of the stencil sheet S. At a lower face of the thermal head 13, there is formed a processing face having a plurality of heat generating members aligned in parallel with the width direction of the stencil sheet S for perforating the stencil sheet by heat. Further, the thermal head 13 can be moved in a direction of approaching the platen roller 12 or retracting therefrom by driving means 17 and in perforating the stencil sheet S, the processing face of the thermal head 13 is opposed to the platen roller 12 and is separated upward from the platen roller 12 after perforation.

The driving means 17 is provided on the side of the press plate frame 9 and is provided with a solenoid 18 and an arm 19. An operating rod 20 of the solenoid 18 is attached with an end of a tension coil spring 21. Other end of the tension coil spring 21 is attached to a portion of the arm 19. The arm 19 is provided pivotably relative to the press plate frame 9. Further, the arm 19 is attached with the thermal head 13. The thermal head 13 is pushed down to a lower side via the arm 19 urged by spring force of the tension coil spring 21 in a state in which the solenoid 18 is not operated and the operating rod 20 is drawn and approaches the platen roller 12. Further, the thermal head 13 is lifted upwardly via the tension coil spring 21 and the arm 19 in a state in which the solenoid 18 is operated and the operating rod 20 is extracted and is separated from the platen roller 12.

The platen roller 12 is disposed to be opposed to the lower side of the thermal head 13 and provided on the side of the frame 6 and is driven to rotate in the counterclockwise direction of FIG. 1 by a drive mechanism, not illustrated, provided on the side of the frame 6.

Further, thermal head claws 22 are provided at both ends of the thermal head 13. The thermal head claws 22 are engaged with a shaft 23 of the platen roller 12 when the press plate frame 9 is closed and the thermal head 13 and the platen roller 12 are positioned to be opposed to each other.

As described above, the stencil sheet S which has passed through the tension roller 11 and the nip roller 10, is pinched between the platen roller 12 and the thermal head 13 which are brought into contact with each other. The stencil sheet S is perforated by being heated and perforated by the thermal head 13 while being transferred by the rotating platen roller 12. The stencil sheet S after perforation is transferred by driving to rotate the platen roller 12 and is delivered to the side of the cutter unit 14.

The cutter unit 14 is provided at the frame 6 and is constituted to pass the stencil sheet S. At the portion of passing the stencil sheet S, there is provided a cutter movable in the depth direction of FIG. 1, that is, in the width direction of the stencil sheet S. Further, the stencil sheet S is cut in accordance with movement of the cutter.

In this way, respective constitutions of the above-described stencil printing machine constitute a stencil making unit with the frame 6 as its base portion. Further, the frame 6 (stencil making unit) is made movable by a moving mechanism relative to the machine body 1 of the printing machine.

An explanation will be given of the moving mechanism as follows.

The frame 6 is supported on the side of the machine body 1 by a guide portion such that the frame 6 can be moved from a position shown in FIG. 1 in the left direction to the above-described respective printing drums 2. With regard to the guide portion, although not particularly illustrated, for example, there is conceivable a constitution in which guide rails are provided at the machine body 1 and the frame 6 is engaged with the guide rails to move therealong. Further, the guide portion according to the embodiment is constituted such that the frame 6 is moved in the horizontal direction since the respective printing drums 2 are arranged such that axis lines of their own are made horizontal. In this way, the guide portion is supported such that the frame 6 (stencil making unit) is moved in a direction in correspondence with arrangement of a plurality of the printing drums 2.

The frame 6 movably supported by the guide portion is driven to move by a drive unit. The drive unit is arranged on the side of the machine body 1 and on the side of the frame 6. On the side of the machine body 1, there is provided a rack gear 25 along a direction of moving the frame 6. Further, the frame 6 is provided with a gear 26 which is moved by itself and is always in mesh with the rack gear 25. The gear 26 is fixed to a shaft 29 rotatably supported by the side of the frame 6. Further, a drive motor 27 is provided at;the frame 6. A drive gear 28 is provided at an output shaft of the drive motor 27. The drive gear 28 is in mesh with a driven gear 30 fixed to the shaft 29 of the gear 26.

When the drive motor 27 is driven, rotation is transmitted to the shaft 29 via the drive gear 28 and the driven gear 30 and the gear 26 is rotated. The gear 26 is rolled by its own rotation in a state of being in mesh with the rack gear 25. Thereby, the shaft 29 is moved along the rack gear 26 and the frame 6 is moved.

The position of the frame 6 moved by the drive unit is detected by position detecting means. Position sensors 31 are provided on the side of the machine body 1. The position sensors 31 according to the embodiment is paired with light projecting and receiving portions. The position sensors 31 are arranged at a total of three locations of positions for detecting that the frame 6 is moved to positions at which an end portion of the perforated stencil sheet S is to be delivered to the two printing drums 2 and a position for detecting that the frame 6 is moved at a position substantially a middle between the respective printing drums 2. Further, on the side of the frame 6, there is provided a shield plate 32 for shielding light projecting and receiving portions of the position sensors 31. The shield plate 32 shields the light projecting and receiving portions of the respective position sensors 31 in accordance with movement of the above-described frame 6.

Here, an explanation will be given of a specific relation between the position sensors 31 and the shield plate 32 in accordance with the movement of the frame 6 in reference to FIG. 1 through FIG. 3.

As shown by FIG. 1, when the frame 6 (stencil making unit) is disposed at the position at which the stencil sheet S is to be delivered to the printing drum 2 on the right side, the shield plate 32 shields only the position sensor 31*a* on the right side. In order to set the stencil making unit at the position, the frame 6 may be moved from the state shown in FIG. 1 in the right direction where all of the position sensors 31 are not shielded by the shield plate 32, and then, the frame 6 is moved to return in the left direction from the position and movement of the frame 6 may be stopped at a position where the position sensor 31*a* is shielded again by the shield plate 32.

Further, as shown by FIG. 2, when the frame (stencil making unit) is disposed at a position at which the stencil sheet S is to be delivered to the printing drum 2 on the left side, the shield plate 32 shields both of the position sensor 31*c* on the left side and the position sensor 31*b* at the center. In order to set the stencil making unit at the position, the frame 6 may be moved in the left direction from a state in which the shield plate 32 shields only the position sensor 31*b* and movement of the frame 6 may be stopped at a position where the position sensor 31*c* is shielded by the shield plate 32.

Further, as shown by FIG. 3, when the frame 6 (stencil making unit) is disposed at a middle position between the respective printing drums 2, the shield plate 32 shields both of the position sensor 31*b* at the center and the position sensor 31*a* on the right side. In order to set the stencil making unit at the position, when the stencil making unit is moved from the state of FIG. 1, the frame 6 may be moved in the left direction from a state in which the shield plate 32 shields only the position sensor 31*a* and movement of the frame 6 may be stopped at a position at which the position sensor 31*b* is shielded by the shield plate 32. Further, when the frame 6 is moved from the state of FIG. 2, the frame 6 is moved in the right direction and the movement is continued in the right direction even from a state in which the position sensor 31*c* is not shielded by the shield plate 32 and the position sensor 31*a* is shielded by the shield plate 32. Further, the frame 6 may be moved to return in the left direction from a position at which the position sensor 31*b* is not shielded by the shield plate 32 (state in which only the position sensor 31*a* is shielded by the shield plate 32) and movement of the frame 6 may be stopped at a position at which the position sensor 31*b* is shielded again by the shield plate 32.

Next, an explanation will be given of operation of the above-described stencil printing machine.

In order to set the stencil sheet S between the above-described respective rollers, the press plate frame 9 is opened to the upper side. At this occasion, the nip roller 10 and the thermal head 13 arranged on the side of the press plate frame 9 are lifted along with the press plate frame 9 and the nip roller 10 is separated from the tension roller 11 and the thermal head 13 is separated from the platen roller 12. From this state, the stencil sheet S in a shape of a continuous strip is reeled out from the stencil sheet S in the roll-like shape contained in the master holder 7. The stencil sheet S is arranged to be brought into contact with respective peripheral faces on upper sides of the tension roller 11 and the platen roller 12. Further, the press plate frame 9 is closed and the stencil sheet S is pinched between the nip roller 10 and the tension roller 11 and between the thermal head 13 and the platen roller 12.

In the stencil making operation, image information is provided to the thermal head 13. The image information can be read by, for example, an original reading apparatus, not illustrated. The thermal head 13 forms a perforated image in correspondence with the image information at the stencil sheet S pinched between the thermal head 13 and the platen roller 12. During the stencil making operation, the stencil sheet S is transferred to direct its front end to the printing drum 2 to which the frame 6 (stencil making unit) corresponds only by a drive force of the platen roller 12.

In the above-described stencil making operation, the stencil sheet S which is reeled out from the stencil sheet S in the roll-like shape and is transferred, is pinched between the tension roller 11 having the torque limiter and the nip roller 10 and therefore, the stencil sheet S is transmitted to the side of the thermal head 13 in a state of being always exerted with constant tension. Therefore, slack is not caused in the transferred stencil sheet S and wrinkle is difficult to cause in the stencil sheet S after perforation.

Further, the stencil printing machine according to the embodiment carries out the stencil making operation and carries out operation of mounting the stencil sheet S to the printing drum 2. Therefore, the front end of the stencil sheet S which has been perforated by the above-described stencil making operation is delivered to the clamp plate 4 of the printing drum 2 by rotation of the platen roller 12. The front end of the stencil sheet S is fixed to the printing drum 2 by the clamp plate 5. Further, the printing drum 2 is rotated and operation of mounting to make the stencil sheet S wrap on the peripheral face of the printing drum 2 is carried out. Further, in the operation of mounting the stencil sheet S to the printing drum 2, at a time point at which the mounting operation of one block has been finished, a processing face 13*a* of the thermal head 13 is separated from the platen roller 12 by the driving means 17, the stencil sheet S is relieved of being pinched and the stencil sheet S is cut by the cutter unit 14.

The stencil printing machine is engaged with a perforating and mounting operation, described above, and the perforating and mounting operation is carried out to the other printing drum 2 by moving the frame 6 (stencil making unit).

After carrying out the perforating and mounting operation with regard to the printing drum 2 on the right side as shown by FIG. 1, the perforating and mounting operation is carried out with regard to the printing drum 2 on the left side. With regard to the movement of the frame 6, the movement is carried out by the above-described moving mechanism. Further, with regard to positioning of movement position of the frame 6, the positioning is carried out by the above-described position detecting means. That is, by driving the drive motor 27 of the moving mechanism, the frame 6 is moved to the printing drum 2 on the left side. Further, when the frame is detected to dispose at a position in correspondence with the printing drum 2 on the left side as shown by FIG. 2 by the position sensor 31*c* of the position detecting means, movement of the frame 6 is stopped. Further, after moving the frame 6, the above-described perforating and mounting operation is carried out. Thereby, operation of mounting the perforated stencil sheet S to the respective printing drums 2 is finished.

In the printing operation, the respective printing drums 2 are rotated and as shown by an arrow mark A of FIG. 1, a print sheet is delivered between one (left side of FIG. 1) of the printing drums 2 and a corresponding one of the pressing means 5 at a predetermined timing. The pressing means 5 presses the print sheet to an image portion of the stencil sheet S mounted to one of the printing drums 2. Printing ink supplied from the inner peripheral wall of one of the printing drums 2 passes through the peripheral wall 3 and is transcribed from a perforated portion of the stencil sheet S onto the print sheet. The print sheet is formed with a perforated image at one of the printing drums 2.

With regard to the print sheet formed with the perforated image at one of the printing drums 2, the print sheet is delivered between the other (right side of FIG. 1) of the printing drums 2 and a corresponding one of the pressing means 5 via the transfer means 40. The pressing means 5 presses the print sheet to an image portion of the stencil sheet S mounted to the other of the printing drums 2. Printing ink supplied from the inner peripheral wall of the other of the printing drums 2 passes through the peripheral wall 3 and is transcribed from a perforated portion of the stencil sheet S onto the print sheet. The print sheet is formed with a perforated image at the other of printing drums 2 and the print sheet is discharged as shown by an arrow mark B of FIG. 1.

Further, the stencil printing machine not only can be moved to positions in correspondence with one and the other of the printing drums 2, described above, but also can move to the middle position between the respective printing drums 2. With regard to the movement of the frame 6 (stencil making unit) to the middle position, the movement is carried out by the above-described moving mechanism. Further, with regard to positioning at the movement position of the frame 6, the positioning is carried out by the above-described position detecting means. That is, the frame 6 is moved to the middle position between the respective printing drums 2 by driving the drive motor 27 of the moving mechanism. Further, when the frame 6 is detected to be disposed at the position in correspondence with the middle position between the respective printing drums 2 as shown by FIG. 3 by the position sensor 31*b* of the position detecting means, the movement of the frame 6 is stopped. In this way, by positioning the frame 6 (stencil making unit) at the middle position between the respective printing drums 2, distances of moving the frame 6 (stencil making unit) to both of the printing drums 2 can be made uniform and in selecting the respective printing drums 2, the stencil making unit can swiftly be moved.

Therefore, according to the stencil printing machine constituted in this way, by enabling the stencil making unit perforating the stencil sheet S to move to a plurality of the printing drums 2, the respective transfer paths and the transfer roller pairs for transferring the stencil sheet S to the respective printing drums 2 and the switch mechanism for selecting the respective transfer paths are dispensed with. Thereby, constituent parts for transferring the stencil sheet S can be reduced.

Further, since the transfer paths and transfer roller pairs are not provided, meandering of the stencil sheet S in transfer operation is not caused and therefore, positions of attaching the stencil sheet S to the respective printing drums 2 become predetermined positions and mounting position failure or wrinkle of the stencil sheet S can be eliminated.

Further, since he respective transfer paths and the transfer roller pairs are not provided, the stencil sheet S is not clogged between upper and lower guide plates constituting the transfer path and folding is not caused at the front end of the stencil sheet S.

Further, although the stencil printing machine according to the above-described embodiment shows an example of adopting the stencil printing machine to the printing machine having two of the printing drums 2, full color printing can be carried out by providing three of the printing drums 2 and carrying out mounting and printing operation in which the three printing drums 2 are distributed with colors of cyan, magenta and yellow.

Further, although the stencil printing machine according to the above-described embodiment is constituted such that the frame 6 (stencil making unit) is moved in the horizontal direction since the plurality of printing drums 2 are arranged such that the respective axis lines are made horizontal, in the case in which in arranging a plurality of the printing drums 2, the respective axis lines are made in parallel with each other and the printing drums 2 are arranged on a locus in, for example, a shape of a circular arc, the stencil printing machine may be constituted such that the frame 6 (stencil making unit) is moved in the circular arc shape along the locus. In this way, movement of the frame 6 (stencil making unit) is derived from an arrangement locus constituted by the plurality of printing drums 2.

As has been explained, according to the stencil printing machine of the present invention, the transfer paths and the transfer roller pairs for transferring the stencil sheet to the respective printing drums and the switch mechanism for selecting the respective transfer paths are dispensed with by moving the stencil making unit perforating the stencil sheet to the plurality of printing drums.

Thereby, constituent parts for transferring the stencil sheet can be reduced. Further, since the transfer paths and the transfer roller pairs are not provided, meandering in transferring the stencil sheet can be avoided and mounting position failure of the stencil sheet with regard to the respective printing drums or wrinkle of the stencil sheet by transfer operation can be eliminated. Further, since the transfer paths and the transfer roller pairs are not provided, clogging of the stencil sheet in the transfer path and folding of the front end of the stencil sheet can be eliminated.

What is claimed is:

1. A stencil printing machine comprising:

a plurality of printing drums arranged to be spaced apart from each other at intervals and adapted to be wound with perforated stencil sheets at respective peripheral walls thereof;

one stencil making unit disposed adjacent to the printing drums for perforating a stencil sheet, said stencil making unit including a thermal head, a platen roller for sandwiching the stencil sheet together with the thermal head for perforation, and driving means attached to the thermal head to move the thermal head in a direction close to and away from the platen roller; and a moving mechanism for supporting the stencil making unit and moving the stencil making unit relative to the respective printing drums, said moving mechanism including a guide portion for supporting the stencil making unit movably relative to the respective printing drums, a drive portion for moving the stencil making unit via the guide portion, and position detecting means for detecting that the stencil making unit is disposed at a desired position, said position detecting means having at least three position sensors arranged along the guide portion and a shield plate attached to the stencil making unit cooperating with the position sensors to detect mounting positions.

2. The stencil printing machine according to claim 1, wherein said driving means is actuated such that the thermal head closely faces the platen roller when the stencil sheet is perforated, and the thermal head is moved away from the platen roller when the stencil sheet is not perforated.

3. The stencil printing machine according to claim 1, wherein a number of the position sensors is larger than a number of the printing drums provided along the guide portion, said position a detecting means detecting the mounting positions of the stencil making unit and a middle position between contiguous two mounting positions.

4. A stencil printing machine comprising:

a plurality of printing drums arranged horizontally to be contiguous to each other at intervals such that respective axis lines thereof are made parallel to each other and adapted to be wound with perforated stencil sheets on respective peripheral walls thereof;

one common stencil making unit for perforating and delivering stencil sheets to be wound around the printing drums;

a guide portion provided along a moving path including a plurality of mounting positions at which the stencil making unit respectively supplies the stencil sheets to the respective printing drums and supporting the stencil making unit to be capable of moving along the moving path;

a drive portion provided at the stencil making unit for moving the stencil making unit along the guide portion; and position detecting means including position sensors arranged along the moving path of the stencil making unit, a number of the position sensors being larger than a number of the printing drums provided along the moving path, said position detecting means detecting the mounting positions of the stencil making unit and a middle position between contiguous two of the mounting positions.

5. The stencil printing machine according to claim 4, wherein said position detecting means includes at least three position sensors, one of said at least three position sensors being disposed at the middle position located in a center of the two mounting positions equally spaced from the two mounting positions so that the stencil making unit located in the middle position can be moved quickly to either one of the two mounting positions.

* * * * *